US007975384B2

(12) United States Patent
Shapiro

(10) Patent No.: US 7,975,384 B2
(45) Date of Patent: Jul. 12, 2011

(54) APPARATUS AND METHODS FOR FACILITATING INSTALLATION OF CONDUIT SYSTEMS

(76) Inventor: Nathan Shapiro, Parsippany, NJ (US)

( * ) Notice: Subject to any disclaimer, the term of this patent is extended or adjusted under 35 U.S.C. 154(b) by 1025 days.

(21) Appl. No.: 11/780,622

(22) Filed: Jul. 20, 2007

(65) Prior Publication Data

US 2009/0019699 A1 Jan. 22, 2009

(51) Int. Cl.
*B21D 47/00* (2006.01)
*E04H 12/00* (2006.01)

(52) U.S. Cl. ..... 29/897.3; 29/897.31; 52/653.1; 52/653.2

(58) Field of Classification Search ..... 29/897.3, 29/897.31; 52/653.1, 653.2, 656.1
See application file for complete search history.

(56) References Cited

U.S. PATENT DOCUMENTS 5,493,834 A * 2/1996 Nelson ..... 52/349
* cited by examiner

*Primary Examiner* — David P Bryant
*Assistant Examiner* — Alexander P Taousakis
(74) *Attorney, Agent, or Firm* — McCarter & English, LLP

(57) ABSTRACT

Apparatus/systems and methods are disclosed for facilitating installation of conduit systems through construction openings. Exemplary embodiments enable one to form, maintain, and controllably block the openings and incorporate the apparatus/systems into the finished construction. Exemplary apparatus/systems disclosed include (i) a structural member that includes one or more side walls defining an opening, one or more base flaps, and one or more top flaps, and (ii) at least one cover to controllably block said opening. Exemplary methods disclosed include (i) installing said apparatus/system that includes (1) securing the structural member relative to a deck, and (2) introducing cement/concrete relative to structural member covering the base flaps and fixing the structural member with respect to the deck, and (ii) installing a conduit system through an apparatus/system-defined opening that includes encasing the cover(s) together with the installed conduit system.

11 Claims, 4 Drawing Sheets

APPARATUS AND METHODS FOR FACILITATING INSTALLATION OF CONDUIT SYSTEMS

BACKGROUND

1. Technical Field

The present disclosure is directed toward apparatus, systems and methods for facilitating installation of a conduit system within a structure e.g., a building. More specifically, the present disclosure is directed toward apparatus, systems and methods that facilitate installation of a conduit systems, e.g. HVAC conduit systems, that extend, inter alia, between levels of a building or other structure, wherein the apparatus, systems or methods include a structural unit configured and dimensioned to define and maintain an opening during the construction process and a cover to controllably block or substantially block the opening, e.g., for safety purposes.

2. Background Art

During the construction of a building or other structure, it is common to leave openings through the floors of the structure through and within which a third party, e.g. an HVAC sub-contractor(s), will, at a later date, install a conduit system for the air conditioning and heating units. These openings are often times also used to facilitate the transfer of material from floor to floor and thus, if safely and correctly maintained, can be beneficial to the overall construction process.

Currently, the formation and maintenance of floor opening carries with it many inherent disadvantages and problems as well. Conduit systems often times will traverse the full height of the structure, making such openings potentially hazardous to workers above and below alike. The current extent of safety measures employed in this particular art is generally limited to covering the opening with a plywood board or its equivalent.

The conventional approach to the situation carries with it many clear risks and disadvantages. For example, a board may be improperly fixed (if at all) to the floor during the installation process. Indeed, a periodic need to work through the opening may require that the board be movable relative to the opening, thereby increasing the potential risk of inadvertent and/or undesired displacement thereof. Such displacement increases the risk that individuals and/or objects will fall through the opening. Furthermore, union policies could encumber the process of replacing a displaced board; e.g. by limiting the body of qualified parties who may do so.

Beyond the potential unreliability of conventional boards in preventing workers and/or objects from falling through such openings, conventional approaches to forming/defining an opening in a floor, e.g. to facilitate subsequent HVAC installation, generally involve construction of an upstanding wooden frame mounted on top of a wooden sub-floor/deck. The height of the frame generally constructed so as to permit the pouring of cement/concrete to a desired depth/thickness onto the wooden sub-floor/deck and around the frame. After the cement/concrete hardens the wooden sub-floor/deck and frame are removed, e.g. chipped away, leaving behind the finished cement/concrete layer and defining an opening therethrough. This process carries with it many clear disadvantages. I.e. the construction and removal of the wooden frame can be costly, time-consuming. and generally, inefficient. With respect to HVAC conduit systems, it is important to note that fire code regulations often necessitate a careful and thorough removal of the wooden frame.

In view of the clear limitations of conventional approaches to forming and maintaining an opening in a floor during construction activities, a need clearly exists for improved apparatus, systems and methods that enhance safety. In addition, apparatus, systems and methods are needed that are easily, efficiently, and reliably used to form and maintain an opening in a floor, e.g., an opening configured and dimensioned for receipt of an HVAC or other conduit system. Apparatus, systems and methods that satisfy the above-noted parameters and simultaneously comply with all applicable building code requirements are also needed.

The foregoing needs are satisfied by the disclosed apparatus, systems and methods disclosed herein, as will be apparent to persons skilled in the art based on the narrative description, particularly when read in conjunction with the appended figures.

SUMMARY OF THE DISCLOSURE

Advantageous apparatus, systems and methods for facilitating installation of conduit systems in the construction of buildings are provided according to the present disclosure. The disclosed apparatus, systems and methods provide simple, cost-effective means for managing potentially hazardous openings such as those formed and maintained during a construction process for later installation of conduit systems and the like. To this end, in an exemplary embodiment of the present disclosure, advantageous apparatus and systems enable one to efficiently form/define such opening(s), to substantially block or unblock such opening(s) as needed without implicating union policies or OSHA regulations, and to generally incorporate the apparatus into the greater construction process.

Exemplary apparatus and systems disclosed herein include a structural member and a cover. More particularly, the structural member generally includes one or more side walls defining an opening therethrough, one or more base flaps extending outwardly relative to the side wall(s), and one or more top flaps extending outwardly relative to the side wall(s). The cover is pivotally connected with respect to the structural member so as to controllably obstruct or block the opening. In an exemplary embodiment, the cover is hingedly connected with respect to the structural member so as to controllably obstruct or block the opening. However, alternative pivotal connections are expressly contemplated according to the present disclosure. In an exemplary embodiment, the cover is pivotally connected with respect to one or more of the top flaps so as to provide means for substantially blocking or unblocking the opening, as needed. However, the present disclosure is not limited by or to such exemplary configuration. Indeed, the cover may, alternatively, be pivotally connected relative to any one or combination of localities on the structural member, including one or more side walls.

The bottom flap(s) are configured and dimensioned to facilitate mounting of the structural member with respect to a sub-floor/deck. The structural member may define openings of various geometry, e.g., square openings, rectangular openings, circular openings, elliptical openings and the like. The height of the side wall(s) may vary from installation-to-installation. In exemplary embodiments of the present disclosure, the side wall(s) define a height of between about 6" to 12", although alternative heights may be employed without departing from the spirit or scope of the present disclosure. The pivotally connected cover is typically configured and dimensioned to fully (or substantially fully) obstruct the opening defined by the side wall(s). However, multiple covers may be pivotally connected with respect to the structural member, e.g., on opposite sides of the opening, such that, in combination, the opening is fully (or substantially fully) obstructed, e.g., akin to a "barn door" arrangement. Multiple covers supported by the structural member may also overlap, in whole or in part, in obstructing the opening.

Methods disclosed herein include, but are not limited to, (i) methods for installation of the disclosed apparatus/system, and/or (ii) methods for installation of a conduit system through the opening defined by such apparatus/system. Thus, in an exemplary implementation hereof, an apparatus/system is first mounted relative to a sub-floor/deck by securing one or more of the base flaps of the structural member with respect to the sub-floor/deck. Cement/concrete is then introduced onto the sub-floor/deck and around the apparatus/system such that the base flaps are covered and fixed thereby. After the cement/concrete layer substantially sets/hardens, the sub-floor/deck is removed resulting in a cement/concrete barrier with the apparatus/system defining an opening there-through.

In an exemplary embodiment, one or more of the base flaps is secured to the sub-floor/deck e.g. with nails, screws, bolts, adhesive, and/or combinations thereof. However, other means of securing the base may likewise be employed including but not limited to the use of clamps, vices, ropes, straps, spikes, tacks, weights, notches or carvings in the sub-floor/deck itself, textured surfaces of one or more base flaps, and/or combinations thereof. It is also contemplated that one or more base flaps may be temporarily secured relative to the deck by hand.

As secured, the side wall(s) of the structural member are in an upstanding orientation relative to the sub-floor/deck. Generally, the structural element performs the function of and thus eliminates the need for the construction of a wooden frame. In an exemplary embodiment the cover is typically pivoted into an obstructing orientation, i.e., extending across the opening and supported by the side wall(s) of the structural member. However, the cover may also be removed or obtained separately from the structural element and remain so until after the structural element is fixed within the cement/concrete layer.

To form a cement/concrete layer relative to the sub-floor/deck, cement/concrete is introduced to the building site, i.e., atop the sub-floor/deck. The upstanding side wall(s) of the structural member form a barrier, such that the cement/concrete cannot enter or reach the opening to be defined. As the cement/concrete is introduced atop the sub-floor/deck, the base flaps of the structural member are typically covered thereby, thereby fixedly securing the structural member relative to the cement/concrete layer. Cement/concrete is generally introduced to a height that substantially corresponds to the height of the side wall(s) of the structural member. In an exemplary embodiment, the top flaps are encompassed by such cement/concrete, thereby further fixing and stabilizing the structural member relative to the cement/concrete layer. The sub-floor/deck is then removed once the cement/concrete layer has substantially hardened/set.

In an exemplary embodiment the cover remains free to pivot relative to the side wall(s) of the structural member throughout the fixation process. Alternatively, the cover is pivotally connected relative to the structural member only after the cement/concrete has hardened/set. To the extent the cement/concrete impinges upon the location and/or desired path of the cover or (in the case of a detached embodiment) the cover's would be location and/or path, it is generally desired to remove such material from the structural member, cover and/or surrounding location, e.g., by conventional chiseling or the like. At this juncture, the structural member defines an opening through the cement/concrete layer and is configured/dimensioned to facilitate introduction of conduit member(s) or other building materials (e.g., wires, pipes, cables and the like) therethrough at such time as is convenient for the building trades.

In exemplary implementations of the present disclosure (post-installation of the apparatus), the cover remains pivotally secured to the structural member during and after installation of a conduit system. More particularly, the cover is pivoted or otherwise positioned so as to unblock the opening and allow for installation of the conduit system. Generally, a framed enclosure is built around installed conduit systems encasing the system in, for example, a wall or pillar. In an exemplary embodiment, when building such framed enclosure, the cover is generally pivoted or otherwise positioned within the framed enclosure so as to engage the inner face of the framed enclosure or the outer face of the conduit system, e.g., ductwork. In either case, the disclosed method for implementation of the disclosed apparatus/system eliminates any potential labor, costs or inefficiencies that would result from a need to remove the disclosed cover. Of note, the structural member and cover are typically fabricated from a material that complies with applicable building/fire codes such that their positioning within the framed enclosure raises no potential issues.

The apparatus, systems and methods of the present disclosure thus provide, inter alia, a cost-effective, efficient and reliable means for promoting and ensuring safety of construction workers. The disclosed apparatus, systems and methods thus offer numerous benefits to construction workers, contractors and building owners alike. The disclosed apparatus/system is relatively straightforward and inexpensive to manufacture and use. Indeed, a less hazardous work environment should lead to fewer accidents, greater efficiency and a reduced potential for liability.

Additional advantageous features, functions and applications of the disclosed apparatus, systems and methods will be apparent from the descriptions which follow, particularly when read in conjunction with the appended figures.

BRIEF DESCRIPTION OF THE DRAWINGS

To assist those of ordinary skill in the art in making and using the disclosed apparatus and methods, reference is made to the accompanying figures, wherein.

DESCRIPTION OF EXEMPLARY EMBODIMENTS

The disclosed apparatus, systems and methods facilitate installation of conduit systems in building construction in a simple and cost-effective manner. Indeed, the present disclosure permits contractors and other building trades to manage potentially hazardous openings that are formed and maintained during the construction process for later installation of conduit systems and the like. In an exemplary embodiment the disclosed apparatus/systems generally take the form of self-contained, modular units that are easily installed and that comply with all applicable building codes. Alternatively, the disclosed apparatus/systems may take the form of a kit where the cover and structural member may be obtained separately for on-site assembly prior to or during the installation process.

Figure 1:
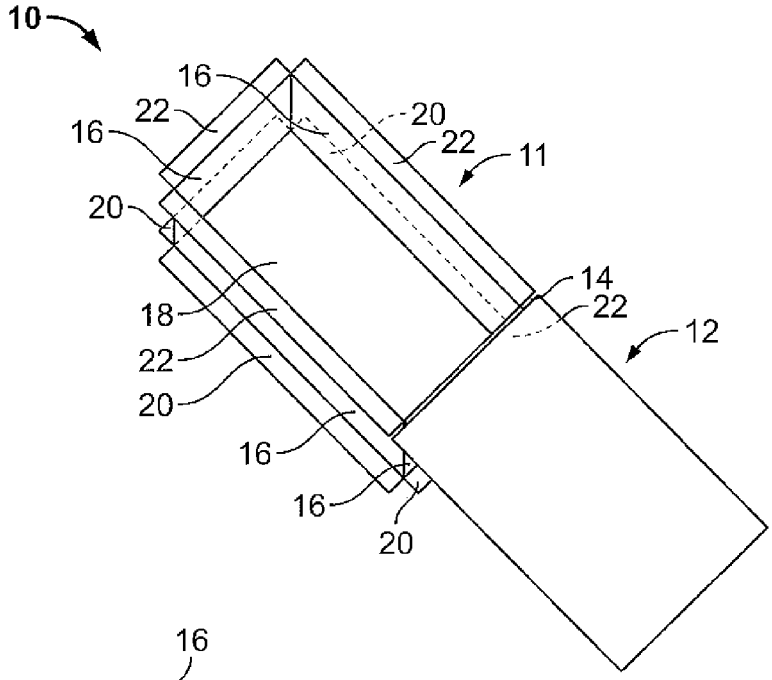
FIG. 1 is a perspective view of an exemplary embodiment of a structural member and cover (in the open position).

With initial reference to FIG. 1, a top perspective view of exemplary apparatus 10 is schematically depicted. Apparatus 10 includes a structural member 11 and cover 12 that is depicted in an open position. The structural member 11 includes four side walls 16 that define an opening 18, four base flaps 20, and four top flaps 22. In this exemplary embodiment, the cover 12 is pivotally connected with respect to structural member 11 by hinge 14. Hinge 14 is mounted to a top flap 22 and cover 12, thereby facilitating pivotal motion of cover 12 relative to structural member 11. The precise design and configuration of hinge 14 is not critical to the design and/or operation of the disclosed apparatus 10. Thus, for example, hinge 14 may include a single elongated hinge unit or a plurality of hinge units that are in a spaced relationship. Similarly, alternative pivotal connections other than the hinge are expressly contemplated according to the present disclosure e.g. material elasticity at and/or around the point of connection, wire lacing, slot and lock mechanisms and the like.

Figure 2:
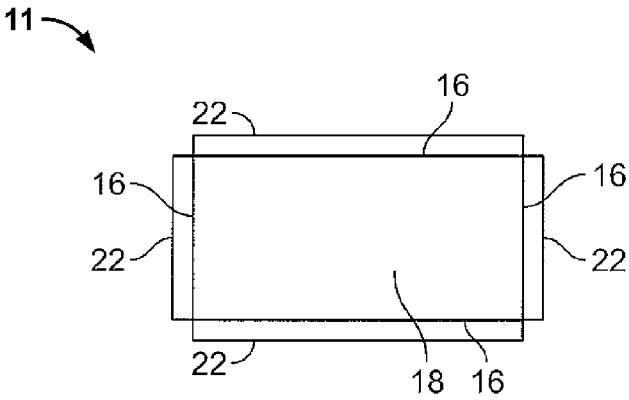
FIG. 2 is a top view of an exemplary embodiment of a structural member.
Figure 3:
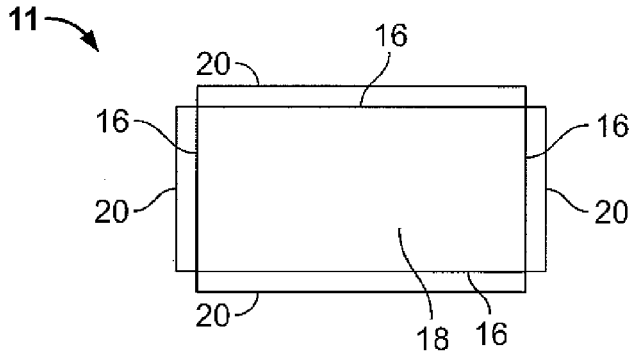
FIG. 3 is a bottom view of the exemplary structural member of FIG. 2.

Referring now to FIGS. 2 and 3, top and bottom views of exemplary structural member 11 are depicted. The four base flaps 20 and four top flaps 22 are shown extending outwardly relative to side walls 16. Base flaps 20 and top flaps 22 are generally integrally formed with side walls 16. Thus, in an exemplary embodiment of the present disclosure, base flaps 20 and top flaps 22 are formed through a bending action relative to adjoining side walls 16 and are oriented in a substantially perpendicular orientation relative thereto. The widths of base flaps 20 are generally selected so as to facilitate mounting of apparatus 10 relative to a sub-floor/deck. Thus, in an exemplary embodiment of the present disclosure, base flaps 20 are about 1 to 3 inches in width. The width of the top flap 22 that interacts with hinge 14 is generally selected so as to provide sufficient surface area to facilitate hinge mounting/interaction. The widths of the remaining top flaps 22 are generally of substantially equal width dimension so to, facilitate interaction/support of the structural member relative to a cement/concrete layer, manufacture of the apparatus, and overall inventory management, e.g. stacking. Exemplary width dimensions for top flaps 22 are between 1 and 3 inches.

Side walls 16 define opening 18 therewithin. In the exemplary embodiment disclosed herein, opening 18 is substantially rectangular in geometry. However, the present disclosure is not limited by or to such exemplary geometry. Indeed, alternative geometries are expressly contemplated according to the present disclosure, including circular geometries, square geometries, and elliptical geometries. Different geometric openings may be particularly suited to specific construction needs, e.g., a circular and/or elliptical opening may be well suited for trash chutes, pipes and the like. In exemplary embodiments of the present disclosure, opening 18 is sized so as to accommodate conventional HVAC conduit structures/ductwork. Thus, opening 18 may define substantially rectangular dimensions of about 24 by 36 inches, although alternative dimensions may be employed without departing from the spirit or scope of the present disclosure. The height of side walls 16 is generally selected to accommodate conventional cement/concrete flooring depths, e.g., between about 6" and 12".

Figure 4:
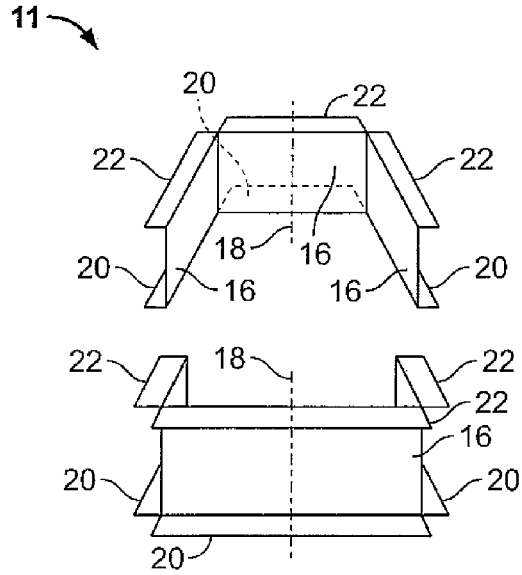
FIG. 4 is a perspective view of an exemplary embodiment of a structural member with side walls exploded apart.

With reference to FIG. 4, an exploded perspective view of exemplary apparatus 10 is provided, wherein structural member 11 includes side walls 16, base flaps 20 and top flaps 22. Base flaps 20 and top flaps 22 extend outwardly relative to side walls 16.

Figure 5:
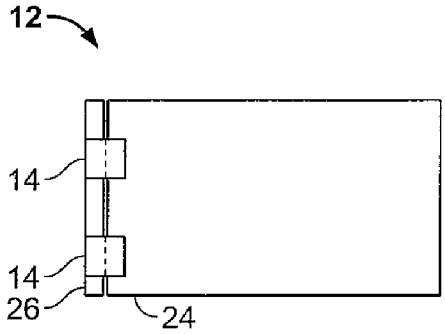
FIG. 5 is an top view of an exemplary embodiment of a cover
Figure 6:
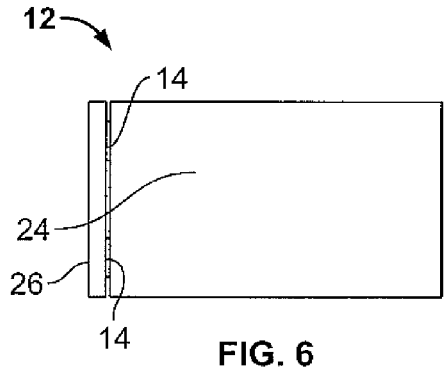
FIG. 6 is a bottom view of the exemplary cover of FIG. 5.
Figure 7:
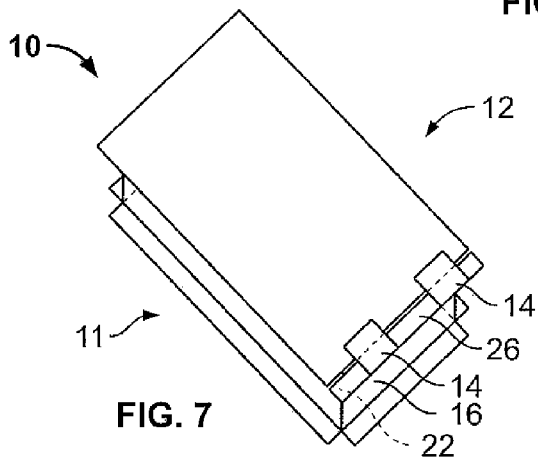
FIG. 7 is a perspective view of an exemplary apparatus according to the present disclosure that includes a structural member and cover (in the closed position).

Referring now to FIGS. 5-7 respectively, top and bottom views of an exemplary cover 12 and a perspective view of apparatus 10 with cover 12 in a closed orientation are provided. In this exemplary embodiment, cover 12 includes a rectangular plate 24 and a flap 26. Hinges 14 are mounted with respect to plate 24 and flap 26 to establish a pivotal connection therebetween. Flap 26 is in turn mounted with respect to top flap 22, thereby pivotally mounting cover 12 with respect to structural member 11. In an alternative embodiment, flap 26 is omitted and hinge(s) 14 are mounted directly between plate 24 and top flap 22. Similarly, in a further exemplary embodiment plate 24 is mounted relative to side wall 16. Cover 12 is configured and dimensioned to fully or substantially block opening 18, thereby preventing an individual and/or object from falling through opening 18 when cover 12 is in a closed orientation.

In alternative embodiments, cover 12 may feature alternative geometries, e.g., based on the geometry of opening 18. Thus, for example, cover 12 may feature a substantially circular geometry for interaction with a structural member that defines a circular opening. In addition, blockage of opening 18 may be achieved through interaction with a plurality of covers 12 that are pivotally mounted with respect to different portions/regions of the periphery of structural member 11. In such implementation, individual covers may be sized to abut (or substantially abut), but not overlap, when in a closed orientation. Alternatively, individual covers may be sized to overlap, in whole or in part, when in a closed orientation, thereby providing greater structural integrity to the cover region, i.e., the cover elements that span the opening.

Figure 8:
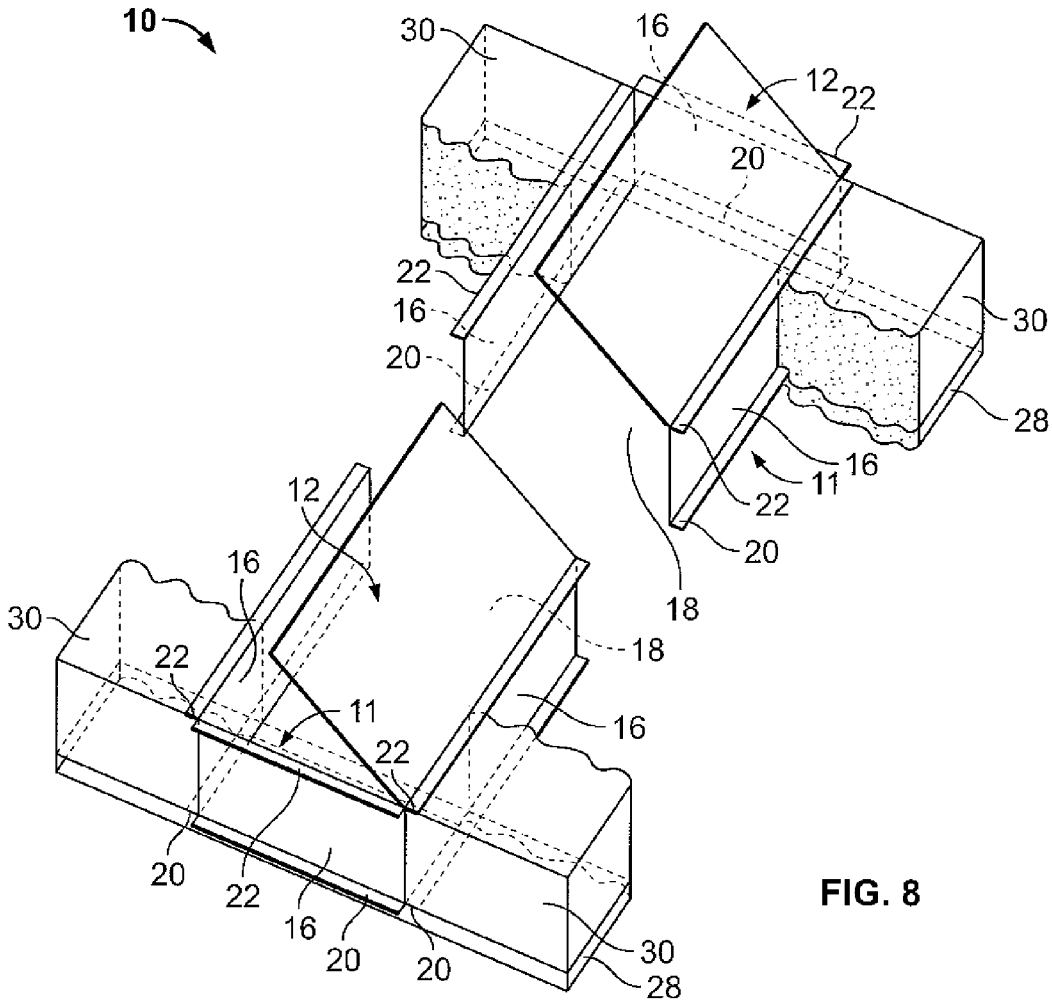
FIG. 8 is an exploded perspective view of an exemplary embodiment of a structural member and cover (in the open position) installed within or positioned with respect to an exemplary barrier before the removal of the sub-floor/deck

Referring now to FIG. 8, a perspective view of an exemplary installation of apparatus 10 is schematically depicted prior to the removal of the sub-floor/deck. As shown therein, structural member 11 with cover 12 attached is installed with respect to a sub-floor/deck 28 and cement/concrete barrier 30. It is important to note that the cover 12 need not be attached to structural member 11 until the end of the installation process. Thus in an alternative embodiment the cover 12 is not pivotally fixed relative to structural member 11 until after the cement/concrete barrier 30 has been introduced and has sufficiently hardened/set.

In exemplary implementations of the disclosed apparatus 10, opening 18 is aligned (or substantially aligned) with a the floor/deck 28 where the conduit systems (e.g., HVAC ductwork) or other materials are to be fed. Bottom flaps 20 are then secured to the sub-floor/deck 28 to maintain the desired alignment. Bottom flaps 20 may be provided with one or more apertures to facilitate nailing/bolting with respect to the sub-floor/deck 28. Alternatively, bottom flaps 20 may be spiked or textured or sub-floor/deck 28 may be notched or carved at the point of juncture so as to facilitate temporarily securing apparatus by hand. When mounted with respect to the sub-floor/deck 28, structural member 11 of apparatus 10 includes upstanding walls 16 that form a barrier with respect to opening 18.

A cement/concrete barrier 30 may be introduced to the sub-floor/deck 28 and around the structural member 11 in a conventional manner. Typically, the cement/concrete barrier 30 is introduced to a desired height based on applicable construction specifications. As introduced, the cement/concrete barrier 30 covers base flaps 20, thereby fixing such base flaps between the sub-floor/deck 28 and cement/concrete barrier 30. The upper surface of cement/concrete barrier 30 generally substantially corresponds with the horizontal plane defined by top flaps 22. In this way, cement/concrete barrier 30 also stabilizes/fixes the top region of structural member 11. Once the cement/concrete barrier 30 hardens/sets the sub-floor/deck 28 is removed. It may also be necessary/desirable to remove/chip away extraneous cement/concrete that impinge upon the operation of hinges 14 and/or movement of cover 12.

Thus, in an exemplary method for installation of the structural member 11 and cover 12 of the present disclosure, the method generally includes the steps of: (1) securing the base flaps 20 to a sub-floor/deck 28 or the like, (2) introducing cement/concrete or comparable material relative to the structural member 11 so as to cover the base flaps 20 and fix structural member 11 with respect to the concrete/cement barrier 30 and (3) removing the sub-floor/deck and cleaning up the extraneous cement/concrete.

Figure 9:
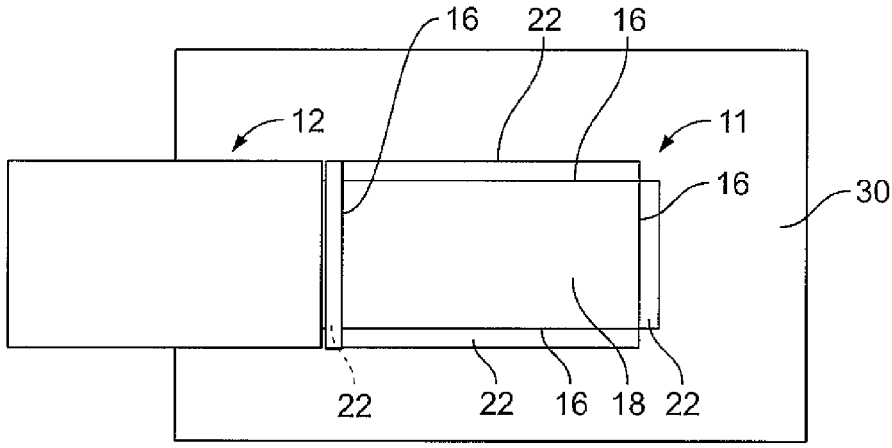
FIG. 9 is a top view of an exemplary apparatus according to the present disclosure that includes a structural member and cover (with cover open for ease of viewing) installed with respect to a barrier.

FIG. 9 schematically depicts structural member 11 embedded within a cement/concrete barrier 30. The cover 12 is free to be pivoted open when and if necessary to complete construction activities. However, the cover 12 will not become detached nor migrate with respect to opening 18, thereby providing enhanced safety to the worksite.

Figure 10:
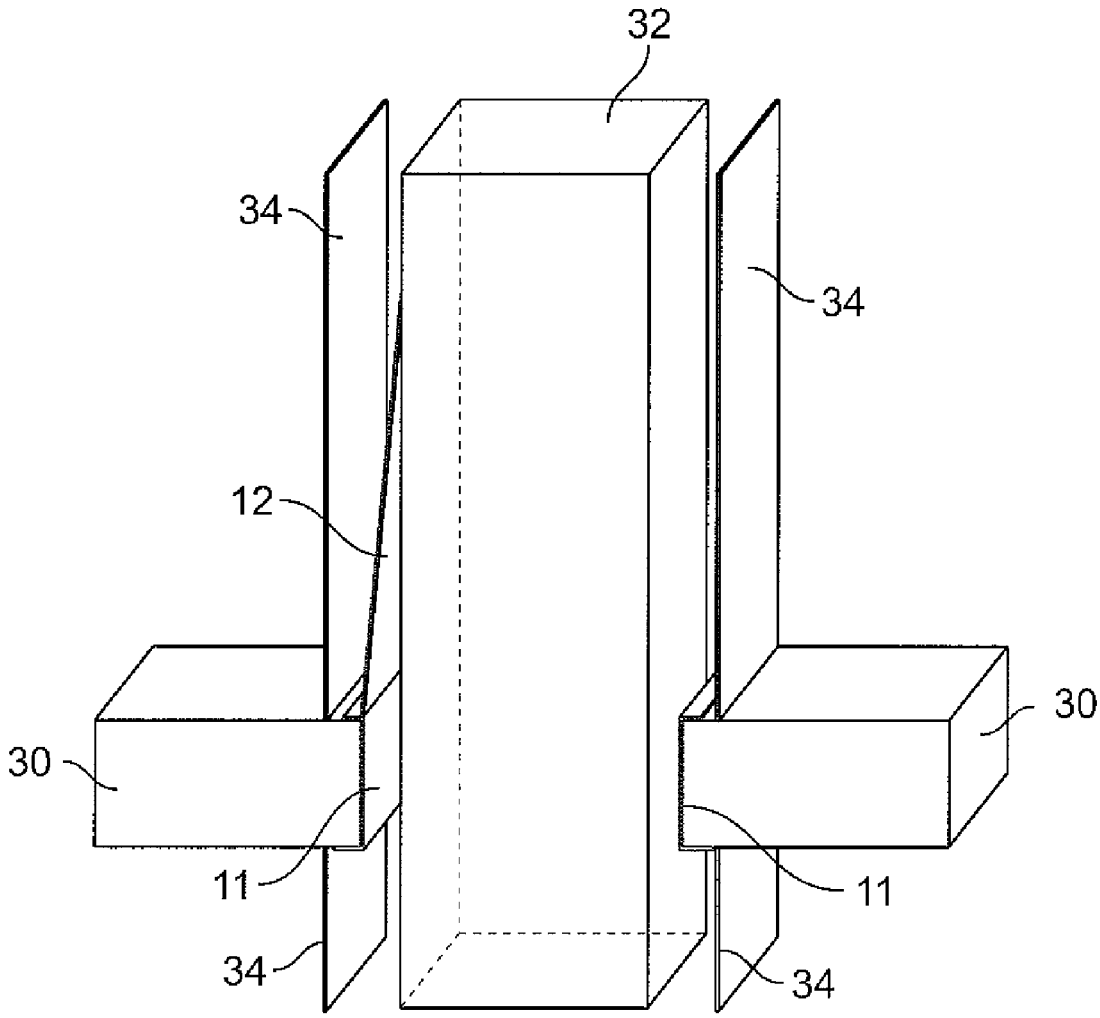
FIG. 10 is a cross-section of a perspective view of a structural member and cover subsequent to installation of a conduit system.

Referring now to FIG. 10, apparatus 10 is depicted with conduit system 32 installed through opening 18. To facilitate installation of conduit system 32, e.g., HVAC ductwork, cover 12 is generally pivoted or otherwise positioned so as to unblock the opening 18 and allow for the insertion/installation of conduit system 32 there-through. A framed enclosure 34 is generally provided around the conduit system 32, as is known in the construction field, and cover 12 generally rests against either the outer face of conduit system 32 or the inner face of the framed enclosure 34. In either case, cover 12 remains an integral component of apparatus 10, thereby eliminating the potential need to remove cover 12 therefrom as the construction process advances. Of note, the positioning of cover 12 within the framed enclosure in either orientation, i.e., resting against conduit system 32 or the framed enclosure 34, complies with all applicable building codes. Note that the sub-floor/deck has already been removed from the cement/concrete barrier 30 depicted in FIG. 10.

Apparatus 10 is generally fabricated from sheet metal, metal plate, duct metal/composite material, or the like. The side walls may be formed into a desired peripheral geometry through conventional metal working technologies, and opposed edges may be joined through conventional welding and/or bolting techniques. The fabrication materials are generally of a suitable thickness to satisfy applicable fire ratings and to provide the requisite structural integrity. Exemplary embodiments of the present disclosure employ sheet metal/plate material that is approximately 16 gage to ⅛" thick, although alternative thicknesses may be employed without departing from the spirit or scope of the present disclosure. The thickness of the cover may vary depending on the size of the opening, given the forces to be supported thereby during the construction process. In further exemplary embodiments, support members, e.g. cross-beams, ribs, and brackets may be attached relative to the structural member to increase the structural integrity thereof and support larger covers.

Although the present disclosure has been described with reference to exemplary embodiments and implementations thereof, the present disclosure is not to be limited by or to such exemplary embodiments and/or implementations. Rather, the apparatus, systems and methods of the present disclosure are susceptible to various modifications, variations and/or enhancements without departing from the spirit or scope of the present disclosure. Accordingly, the present disclosure expressly encompasses all such modifications, variations and enhancements within its scope.

What is claimed is:

1. A method for facilitating installation of a conduit system, the method comprising:

(a) providing an apparatus that includes:
  (i) a structural member including:
    (A) one or more side walls that define an opening,
    (B) one or more base flaps extending outwardly with respect to the one or more side walls, and
    (C) one or more top flaps extending outwardly with respect to the one or more side walls; and
  (ii) one or more covers; and
  (iii) means for pivotally mounting the one or more covers relative to the structural member so to allow the one or more covers to substantially block the opening defined thereby;

(b) installing the structural member relative to a barrier by
  (i) securing one or more of the base flaps of the structural member to a sub-floor/deck,
  (ii) introducing a cement/concrete onto the sub-floor/deck such that the base flaps are covered thereby, and
  (iii) removing the sub-floor/deck, and (c) pivoting or removing the one or more covers so as to unblock the opening of the apparatus for introduction of a conduit system.

2. A method according to claim 1, further comprising installing a conduit system through the opening and encasing the one or more covers along with the conduit system after its installation.

3. A method according to claim 1, wherein the one or more covers are pivotally mounted relative to the structural element after the structural element is installed relative to a barrier.

4. A method according to claim 1, wherein the one or more covers are fabricated from sheet metal, metal plate, or a duct metal/composite material.

5. A method according to claim 1, wherein the means for pivotally mounting at least one of the one or more covers relative to the structural element is one or more hinges.

6. A method according to claim 1, wherein at least one of the one or more covers is pivotally mounted relative to one or more top flaps of the structural element.

7. A method according to claim 1, wherein the structural unit includes four walls defining a rectangular opening.

8. A method according to claim 1, wherein at least one of the one or more covers is comprised of a rectangular plate, wherein the plate is pivotally connected relative to one or more mounting flaps.

9. A method according to claim 1, wherein the total dimensions and geometry covered by the one or more covers is based on the dimensions and geometry of the opening.

10. A method according to claim 1, wherein the height of the structural element is substantially the same as the thickness of the cement/concrete layer introduced so that the horizontal plane defined by the top flaps substantially corresponds with the upper surface of the cement/concrete layer.

11. A method according to claim 1, wherein the base flaps are secured relative to the sub-floor/deck prior to the introduction of cement/concrete by hand.

* * * * *